US006866152B2

(12) United States Patent
Grumbach

(10) Patent No.: US 6,866,152 B2
(45) Date of Patent: Mar. 15, 2005

(54) SYSTEM AND METHOD TO SEPARATE CARDBOARD COMPONENTS FROM BULK WASTE PAPER

(75) Inventor: Udo Grumbach, Harsewinkel (DE)

(73) Assignee: Grumbach GmbH & Co. KG, Harsewinkel (DE)

( * ) Notice: Subject to any disclaimer, the term of this patent is extended or adjusted under 35 U.S.C. 154(b) by 147 days.

(21) Appl. No.: 10/304,983

(22) Filed: Nov. 26, 2002

(65) Prior Publication Data

US 2004/0099584 A1 May 27, 2004

(51) Int. Cl.[7] ..... B07C 1/16
(52) U.S. Cl. ..... 209/615; 209/616
(58) Field of Search ..... 209/688, 699, 209/695, 615, 616

(56) References Cited

U.S. PATENT DOCUMENTS

| | | | | | |
|---|---|---|---|---|---|
| 1,153,381 | A | * | 9/1915 | Gudmunsen | 209/688 |
| 1,416,585 | A | * | 5/1922 | Stables | 209/688 |
| 1,694,817 | A | * | 12/1928 | Gudmunsen et al. | 209/688 |
| 2,338,088 | A | * | 1/1944 | Bleichfield | 209/619 |
| 2,462,128 | A | * | 2/1949 | Roach et al. | 171/25 |
| 2,646,167 | A | * | 7/1953 | Bratun | 209/688 |
| 3,024,903 | A | * | 3/1962 | Jamal | 209/632 |
| 3,145,937 | A | * | 8/1964 | Scovel et al. | 241/68 |
| 3,696,925 | A | * | 10/1972 | Harper | 209/688 |
| 3,993,141 | A | * | 11/1976 | Donohue | 171/63 |
| 4,207,986 | A | * | 6/1980 | Cerroni | 209/616 |
| 4,438,851 | A | * | 3/1984 | Voelskow | 209/616 |
| 4,511,046 | A | * | 4/1985 | Walsh et al. | 209/539 |
| 5,303,623 | A | * | 4/1994 | Chiloff | 83/121 |
| 5,590,789 | A | | 1/1997 | Stricker et al. | 209/11 |
| 5,901,859 | A | * | 5/1999 | Carr et al. | 211/45 |
| 6,394,280 | B1 | * | 5/2002 | Gassner et al. | 209/616 |

FOREIGN PATENT DOCUMENTS

| | | | |
|---|---|---|---|
| DE | 637056 | 11/1936 | 1/44 |

* cited by examiner

*Primary Examiner*—Donald P. Walsh
*Assistant Examiner*—Joseph Rodriguez
(74) *Attorney, Agent, or Firm*—Bourque & Associates

(57) ABSTRACT

A conveyor device (2) is provided on which the bulk material containing both card board and paper is transported to a sorting station (5). At this point, the cardboard components are extracted mechanically. For this, the paper and cardboard components are transported while lying flat, and are only partially supported, for which the conveyor device (2) includes lowered free spaces (7) between the support areas. A receiver device (9) possessing freestanding barbs (11) moves synchronously with the conveyor device (2). These barbs (11) are arranged pointing toward the non-supported sections of the paper and cardboard components, and can extend into the free spaces (7) formed on the conveyor device (2). For this, the cardboard components are transfixed by, and held to the barbs (11) of the receiver device (9), but the paper components are not. The cardboard components are stripped off the receiver device (9) at a point that is spatially separate from the supply end of the conveyor device, at which the paper components, which were not transfixed by the barbs of the receiver device (9), exit.

16 Claims, 3 Drawing Sheets

SYSTEM AND METHOD TO SEPARATE CARDBOARD COMPONENTS FROM BULK WASTE PAPER

TECHNICAL FIELD

The invention relates to a procedure and a machine to separate cardboard components from bulk waste paper consisting of softer paper components and stiffer cardboard components.

BACKGROUND INFORMATION

For purposes of the present invention, waste paper means paper collected for recycling that is formed in bulk after coarse sorting that consists of softer paper components and stiffer cardboard components. The paper components are delivered by recycling firms to paper factories that use the paper components for the manufacture of newsprint. Newspapers nowadays are printed on paper that consists to a large extent of recycled paper. This assumes that the used, recycled paper will undergo a de-inking process in which the color components are extracted from the cellulose material. This, however, works only with printed paper, but not with colored paper or cardboard. Therefore, the cardboard components must be separated out of the bulk waste-paper to be recycled.

In practice, it is not possible with justifiable expense to completely extract the cardboard component from a normal mass of waste paper. Therefore, paper factories in which waste paper is used to manufacture newsprint still accept a cardboard content of 2.5%. Therefore, after the coarse sorting process, arriving waste paper undergoes a fine sorting process in which not only colored paper content but also the cardboard content are separated. This fine sorting process is performed manually on moving linear transport devices such as conveyor belts by a large number of workers, and is an activity that must be performed under difficult conditions, and is one whose accuracy decreases as the concentration of the workers decreases in the course of a shift.

From the old German patent document 637 056, a sorting facility for household trash by means of which softer components such as waste paper and fabric may be extracted is known. For this, a transport belt equipped with barbs is provided onto which the trash components are thrown, and on whose barbs the softer components, including pieces of paper, are transfixed. By means of a drum that engages at the deflection point of the transport belt equipped with barbs, using hooks into slotted teeth of the idler roller as far as below the support area of the transport belt, the transfixed pieces of paper are stripped off the barbs of the transport belt. Discrimination between pieces of softer paper and relatively stiffer cardboard is not provided here.

U.S. Pat. No. 5,590,789 describes a procedure and a device to sort thermoplastic components from a stream of materials, whereby a barbed roller is used. The thermoplastic components transfixed on the barbs of this roller are stripped off along the circumference of the barbed roller at a distance from the reception point by a suitable device. The device known in the document does not provide a device to extract cardboard from bulk waste paper, nor is it suitable for this purpose.

SUMMARY OF THE INVENTION

The task of the present invention is to create a procedure and a machine of the type mentioned at the outset that will enable extraction of cardboard components from bulk waste paper with a constantly high level of accuracy.

The task is solved procedurally by the invention in that the paper and cardboard components are transported flat on a conveyor belt and only partially supported with such a support separation, and in that first, the softer paper components are drawn into the free space below the non-supported sections of the conveyor belt as well as carried further by the conveyor belt by means of ascending barbs of a receiver device over the non-supported sections of the paper and cardboard components, and second, the cardboard components are penetrated and transfixed, after which the cardboard components are stripped off the barbs of the receiver device at a spatial separation from the paper components passing through the conveyor belt.

Further, this task is solved by a suitable machine by means of a conveyor device transporting the paper and cardboard components lying flat. The conveyor device ends at a sorting station, and includes empty spaces in the end area between supporting areas as well as below it, and the task is further solved by means of a receiver device positioned at the sorting station.

This receiver device includes free-standing, projecting barbs, and moves synchronously with the conveyor belt, whereby the barbs of the receiver device are so arranged that they extend down through the lower free spaces of the receiver device and draw along the paper components remaining on the conveyor belt and transfix and extract the cardboard components, and it also includes a stripper device for the cardboard components that is positioned on the one hand in the movement area of the receiver device, and on the other hand, is spatially separated from the exit position for the paper components along the conveyor belt.

Important to the invention is the consideration and realization that printed paper such as newsprint is relatively soft, and thus presents a high degree of flexibility in comparison with cardboard. Resultantly, cardboard may be transfixed by barbs or spines on the receiver device included as part of the invention under certain conditions, while the flexible paper will not be.

Accordingly, the slot dimension or the diameter of the free spaces on the conveyor belt transporting the bulk waste paper is so selected that the barbs of the receiver device may press the paper lying largely flat into these lower free spaces, and, in contrast, the stiffer cardboard in the bridging area between the support positions at the edge of the free spaces will present such a high resistance to bending to the imposed barbs of the receiver device that they are pierced by the barbs. The barbs are shaped accordingly, and especially thus configured in the area of the barb tips.

The cardboard pieces transfixed on the barbs are retained on the receiver device because they are jammed, and are removed from the conveyor device, while the paper components are carried along by the conveyor belt, from which they are expelled. Stripping the cardboard components from the receiver device occurs at another position than where the paper components are expelled from the conveyor device, so that the cardboard components extracted from the receiver device may be spatially separated from the paper components.

With a conveyor device for the transport of bulk waste paper so that the paper and cardboard components are lying flat, the support separations between the support points which allow piercing of the cardboard lying flat, but not of the flexible paper, may be configured in various ways. Thus, the conveyor device may consist of a conveyor belt that has proper apertures whose positions correspond to the arrangement of the projecting barbs in order to enable the desired barb engagement.

The conveyor device may also consist of a conveyor belt that includes a large number of projecting humps that form the support positions, and between which the barbs of the receiver device extend. Longitudinal slots in the conveyor device are also possible, as will be explained in the following using an embodiment example. In a particularly advantageous embodiment, the barbs of the receiver device may mesh with the roller forming the supply end of the conveyor device that possesses the free spaces to receive the barbs.

Advantageous embodiments of the invention may be taken from the description set forth herein.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
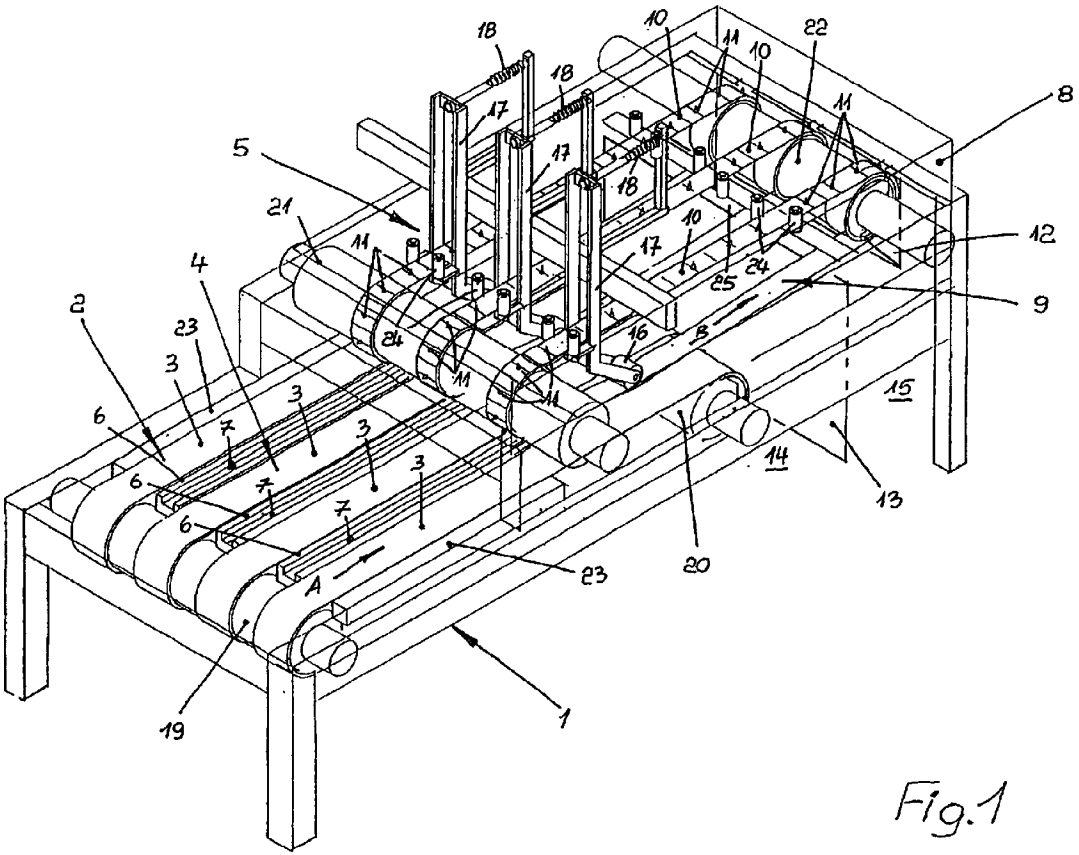
FIG. 1 is a largely schematic, perspective reproduction of a device to extract the cardboard components from bulk waste paper, as seen obliquely from above the supply station.

FIG. 1 shows a frame 1, which supports a conveyor device 2 that consists of conveyor belts 3 positioned parallel with one another and at the same height. The conveyor belts 3 are guided over common idler rollers 19 and 20 that are driven by a motor (not shown). The upper outer side of the carrying run of the conveyor belts 3 represent the transport side of the conveyor device 2; the conveyor belts 3 are moving in the direction of the arrow A. On one end of the frame 1, the transport belts 3 have their transport side free from above, thus forming a supply station 4 at which the paper and cardboard components of bulk waste paper are placed onto the conveyor device 2 lying flat. These paper and cardboard components are transported from the supply station 4 to a sorting station 5.

Another frame 8 is positioned on the frame 1 outside the front supply station 4 that supports a receiver device 9. This receiver device 9 includes circulating belts 10 that are guided over joint idler rollers 21 and 22, of which one is driven by a motor so that the lower carrying runs of the belts 10 move synchronously according to the arrow B with the upper carrying runs of the transport belts 3 of the conveyor device 2 along their supply direction.

The transport belts 3 that are positioned parallel to one another are separated from one another at a specific distance. One of the belts 10 of the receiver device 9 is positioned to flow along with each gap between two of these transport bands 3. The receiver device 9 lies with its outer side of its lower carrying run are essentially at the same height as the outer side of the upper carrying runs of the adjacent transport belts 3. In the area of the sorting station 5, the receiver device 9 with its belts 10 overlaps the conveyor device 2 so that, in the rearward area, the receiver device 9 viewed along the transport direction extends above the reverse idler end of the conveyor device 2.

Glide rails 6 are positioned between the separated transport belts 3 of the conveyor device 2, against whose upper sides the belts 10 of the receiver device 9 are pressed at at least one point at which entry will subsequently be made. The belts 10 have free-standing barbs 11 on their outer sides that do not collide with the glide rails 6 because the glide rails 6 possess longitudinal slots that form hollow cavities 7 below the transport level or surface for the paper and cardboard components being transported while lying flat on it, into which the projecting barbs 11 of the belts 10 of the receiver device 9 may project. Also, the upper sides of the glide rails 6 are at the same level as the outer sides of the upper carrying runs of the transport belts 3, so that the goods placed onto the transport belts 3 which are carried along the transport direction by means of adequate friction may slide along the upper sides of the glide rails 6.

When the mass consisting of paper and cardboard components arrives to the sorting station 5, the barbs 11 on the circulating belts 10 of the receiver device 9 come into play. The barbs 11 that lie about the circumference of the belts 10 of the receiver device 9 in a row with the slots or hollow cavities 7 of the glide rails 6 of the conveyor device 2 press the paper components into the above-mentioned hollow cavities 7 without penetrating the flexible or soft paper. In contrast, the cardboard in the cardboard components bridging the hollow cavities 7 is so stiff that the cardboard is pierced by the barbs 11 on the belts 10, whereby the cardboard components are transfixed on one or more of the barbs 11 on the belts 10. The paper drawn into the hollow cavities 7 and not pierced remains on the conveyor device 2, and is transported further by it.

The paper components move off the conveyor device 2 at the end of the conveyor device 2, i.e., along the transport direction after the idler roller 20, and fall off at exit point 14. In contrast to this, the cardboard components transfixed on the barbs 11 on the belts 10 and adhering to the outer side of the lower carrying runs are passed along and separated using a separation partition 13 that divides the exit point 14 from a exit point 15 for the cardboard components. Above the exit point 15, the belts 10 move past a stripping device 12 with their outer sides facing it. This stripping device 12 strips the cardboard components from the barbs 11 on the belts 10, so that these cardboard components fall off the rear end of the entire device onto the exit point 15.

The two exit points 14 and 15, one for the paper components and the other for the cardboard components, may be configured as supply stations for further transport devices in order to direct the paper and cardboard components along their separate pathways for further use.

It must be ensured that the belts 10 of the receiver device 9 for the cardboard components move in the area of the lower carrying run at the same speed as the upper carrying runs of the transport belts 3 of the conveyor device 2. The specific embodiment of the invention shown in the illustration offers the advantage of being able to provide a relative velocity between the belts 10 of the receiver device 9 and the transport belts 3 of the conveyor device 2, since the belts 10 gliding on the glide rails 6, whose barbs 11 extend through the longitudinal slot-shaped free spaces 7 of the glide rails 6, need not come into contact with the transport belts 3 of the conveyor device 2.

The carrying runs of the belts 10 of the receiver device 9 adjacent to the conveyor device 2 overlap in the area of the input side of the sorting station 5 at their inner sides by means of sensor rollers 16. These sensor rollers 16 may pivot against an elastic resistance. For this, the sensor rolls 10 are mounted on a bracket 17 shaped like a rocker on whose first lever arm is positioned on the sensor roller 16. A tensioning spring 18 engages with the second lever arm of the bracket 17, providing the force onto the particular carrying run of the concerned belt 10. The separation between the lower carrying runs of the belts 10 of the receiver device 9 and the transport side of the conveyor device 2 increases along the transport direction away from the sensor rollers 16.

The belts 10 increase their separation from the conveyor device 2 from each sensor roller 16 up to the input point at the idler roller 21 so that a decreasing angle for the goods to be sorted is formed up to the sensor rollers 10 at the input side of the sorting station 5. If the mass to be sorted lying flat is too thick because of foreign objects such as pieces of wood, then at least one of the sensor rollers 16 pivots along with the concerned run of the belt 10 of the receiver device 9 against the force of the spring 18 to the extent that the entire device stops in order to allow the removal of the foreign object without having to gain access into the separated paper and cardboard components.

It remains to provide a special track at the idler rollers 19 and 20 of the conveyor device 2 in order to guide the transport belts 3, since the lateral displacement of the transport belts 3 is ensured by the glide rails 6 on the one hand, and by additional guide rails 23 on the outer sides of the two transport belts 3 positioned at the outside. Likewise, such guides are not required on the idler rollers 21 and 22 for the belts 10 of the receiver device 9. Guide rollers 24 are provided on both sides of the belts 10 for lateral guiding of the belts 10 near the concerned idler rollers 21, 22 that are positioned on cross spars 25 of the frame 8.

Figure 2:
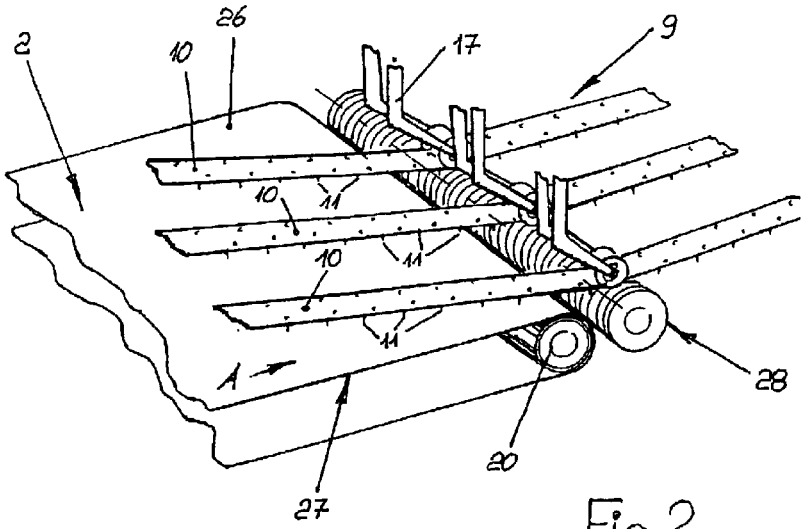
FIG. 2 is a perspective view of another embodiment of the end of the conveyor device transporting the bulk material in the sorting station of a device positioned as shown in FIG. 1.
Figure 3:
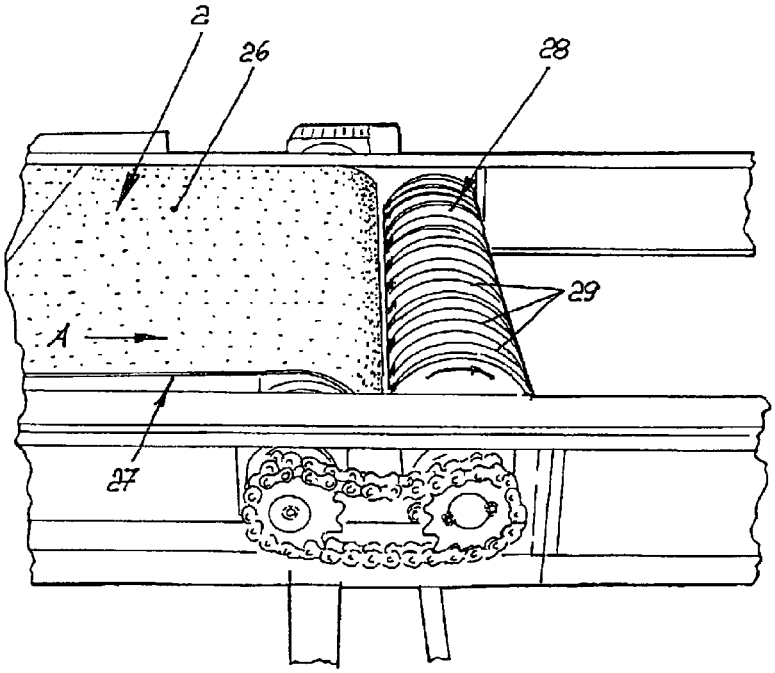
FIG. 3 is an oblique view from above the end of the conveyor device shown in FIG. 2 with the receiver device omitted.

The device shown in FIG. 1 may be modified in a manner shown in FIGS. 2 through 5. Instead of individual transport belts 3, the conveyor device 2 includes a supply belt 26 that extends over the entire transport width of the conveyor device 2. In the same manner as the transport belts 3, the supply belt 26 is passed over idler rollers, one of which is shown in FIG. 2 near the idler roller 20 at the supply end of the conveyor device 2. At the output end of the supply belt 26 is a roller 28 whose upper edge is at the same level as the upper carrying run 27 of the supply belt 26. Also, the axis of the roller 28 is parallel to the idler roller 20 for the supply belt 26, and the separation between the roller 28 and the output end of the supply belt 26 is so small that the mass to be sorted is fed away from the supply belt 20 via the upper edge area of the roller 28. Additionally, the roller 28 may be driven at a circumferential speed corresponding to the supply speed of the conveyor device 2. The roller 28 forms the supply end of the entire conveyor device 2 from which the paper components exit.

The cardboard components are treated differently here too—they are penetrated and transfixed on the barbs 11 of the receiver device 9, as is the case with the embodiment example in FIG. 1. This is why the receiver device 9 is configured the same. The difference from the modified embodiment in FIG. 1 is that the free spaces 7 are provided at the roller 28 into which the barbs 11 of the belts 10 of the receiver device 9 extend or penetrate.

Figure 4:
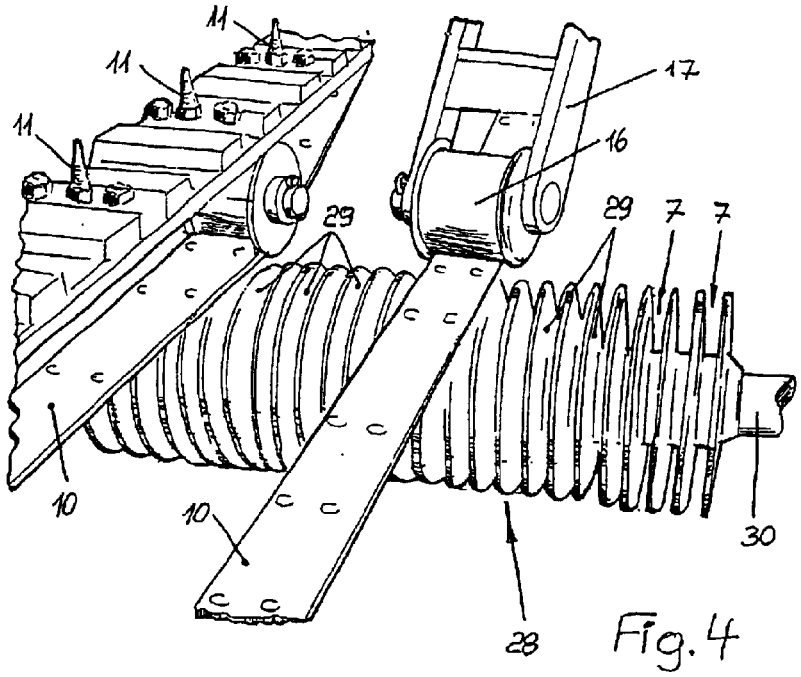
FIG. 4 is a view of the end of the conveyor device as in FIG. 2 viewed along the transport direction.
Figure 5:
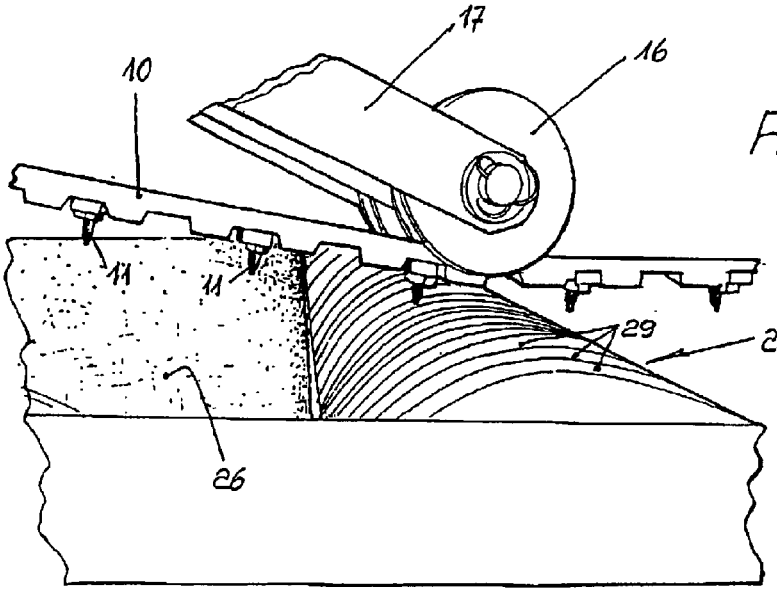
FIG. 5 is another slightly perspective lateral view of the end of the conveyor device as in FIG. 2.

Additionally, in particular as FIG. 4 shows, the roller 28 consists of a large number of coaxially-arranged disks 29 of the same diameter positioned at regular distances along an axis 30. As a result of these distances, a free space 7 exists between two of the named disks 29 that is free for movement in the circumferential direction of the roller 28. On the transport belts 10, the barbs 11 are arranged in a row aligned along the circulation direction, and such a row of barbs is aligned toward one of these free spaces into which the barbs extend. The flexible paper components here are also pressed in by the barbs 11, and drop off the side of the roller 28 facing away from the supply belt 26.

In contrast, the cardboard components bridge over the free spaces 7, and are supported correspondingly by the edges of the disk 29 extending in the circumferential direction of the roller 28. Thus, the cardboard components are also transfixed by the barbs 7 on the belts 10 of the receiver device 9 because of their stiffness, and are carried along by the circulating remover device 9 over the exit side of the roller 28 onto which the paper components are tossed.

In contrast to FIGS. 2–5, the receiver device 9 may include a larger number of belts 10 or, instead of this, one or two such belts with greater width in order to increase the number of rows of barbs 11 engaging with the circumferential free spaces 7 of the roller 28. Also, the roller 28 may be formed at those points at which the barbs 11 do not engage without a circumferential contour including the free spaces 7.

Modifications and substitutions by one of ordinary skill in the art are considered to be within the scope of the present invention which is not to be limited except by the claims which follow.

What is claimed is:

1. A method for extracting cardboard components from bulk waste paper that consists of softer paper components and stiffer cardboard components, comprising the act of:

transporting the paper and cardboard components while lying flat on a conveyor device that is only partially supported using a support gap so that, by means of barbs disposed on a receiver device passing over the support gap forming unsupported sections of the paper and cardboard components, first, at least a portion of the softer paper components are drawn into said support gap below the non-supported sections of the conveyor device, and are then carried along with it, and second, the cardboard components are penetrated and transfixed, after which the cardboard components are stripped from the barbs on the receiver device at a separate location from the paper components falling off the conveyor device.

2. A machine to extract cardboard components from bulk waste paper having softer paper components and stiffer cardboard components, comprising:

a conveyor device that transports flat-lying paper and cardboard components and that ends at a sorting station and includes guide rails having a plurality of free spaces;

a receiver device positioned at the sorting station that is provided with free, projecting barbs that move synchronously with the conveyor device, whereby the barbs of the receiver device are so configured that they extend through the plurality of free spaces of the conveyor device while pulling along the paper components remaining on the conveyor device and while transfixing and receiving the cardboard components; and a stripping device for the cardboard components, spatially separated from the exit point for the paper components from the conveyor device.

3. A machine as in claim 2, wherein the conveyor device includes parallel, circulating transport belts that are positioned at such a distance from one another that free spaces are formed between them.

4. A machine as in claim 3, wherein fixed glide rails are positioned between the transport belts of the conveyor device that include longitudinal slots parallel with the transport belts which form the free spaces.

5. A machine as in claim 2, wherein the conveyor device includes a flat transport side on top, above which the receiver device is positioned.

6. A machine as in claim 2, wherein the receiver device includes at least one circulating belt that carries the barbs on its outer sides.

7. A machine as in claim 6, wherein at least one belt of the receiver device overlaps the conveyor device in the area of the sorting station, and includes an extension area extending beyond the conveyer device.

8. A machine as in claim 7, wherein an exit point for the paper components being ejected from the conveyor device is located substantially below the extension area of the receiver device extending above the conveyor device.

9. A machine as in claim 8, wherein a second exit point, separate from the first exit point, is located substantially below the extension area of the receiver device for the cardboard components stripped from the receiver device, and wherein correspondingly, the stripper device, is positioned proximate the underside of the receiver device extending above the conveyor device.

10. A machine as in claim 6, wherein at least one belt of the receiver device passes under a sharp angle to the end of the conveyor device.

11. A machine as in claim 5, wherein an inner side of at least one belt of the receiver device is provided with a sensor roller that is mounted so that it may pivot against the force of a spring, and by means of which the conveyor device and of the receiver device may be stopped as a result of a pre-determined deflection.

12. A machine as in claim 11, wherein at least one belt of the receiver device near the conveyor device diverges from the sensor roller relative to the end of the conveyor device for the purpose of forming an intake angle.

13. A machine as in claim 2, wherein the conveyor device includes a single supply belt to which a roller is disposed proximate an end of the conveyor device against which the free spaces receiving the barbs of the receiver device are formed.

14. A machine as in claim 13, wherein the roller with its upper area is positioned at approximately the same height as an upper side of the supply belt.

15. A machine as in claim 13, wherein the roller includes coaxial disks that form a free space between adjacent coaxial disks.

16. A machine as in one of claim 13, wherein the roller is driven at a circulation speed substantially synchronously with a supply speed of the supply belt.

* * * * *